US007540829B1

(12) United States Patent
Chen

(10) Patent No.: US 7,540,829 B1
(45) Date of Patent: Jun. 2, 2009

(54) FOLDABLE MECHANISM FOR TREADMILLS

(75) Inventor: Ming Nan Chen, Taichung (TW)

(73) Assignee: Michael Lin, Chong San Chu Taipei (TW)

( * ) Notice: Subject to any disclaimer, the term of this patent is extended or adjusted under 35 U.S.C. 154(b) by 0 days.

(21) Appl. No.: 12/148,470

(22) Filed: Apr. 17, 2008

(51) Int. Cl.
*A63B 22/02* (2006.01)

(52) U.S. Cl. ..... 482/54; 482/51

(58) Field of Classification Search ..... 482/51, 482/52, 54; *A63B 22/02*
See application file for complete search history.

(56) References Cited

U.S. PATENT DOCUMENTS 6,050,923 A * 4/2000 Yu ..... 482/54
6,077,200 A * 6/2000 Lin ..... 482/54
6,723,027 B1 * 4/2004 Lo ..... 482/54
2006/0003869 A1 * 1/2006 Huang et al. ..... 482/54
2006/0040798 A1 * 2/2006 Weier et al. ..... 482/54
2007/0066448 A1 * 3/2007 Pan et al. ..... 482/54
2008/0188358 A1 * 8/2008 Kuo ..... 482/54

* cited by examiner

*Primary Examiner*—Fenn C Mathew
*Assistant Examiner*—Andrew M Tecco
(74) *Attorney, Agent, or Firm*—Charles E. Baxley, Esquire

(57) ABSTRACT

A foldable mechanism for treadmills includes two respective foldable sets and an operation bar is connected to the two foldable sets. Each foldable set has an operation member fixed to the upright frame corresponding thereto and the operation member has a groove defined in a side thereof. A periphery defining the groove includes multiple recesses. Two end plates each have a first end fixed to one of two ends of the operation bar and the other end of each end plate is pivotably connected to the foldable set corresponding thereto. An engaging member extends from the first end of each end plate and is movably inserted into the groove of the operation member. When pivoting the upright frames toward the horizontal frame of the treadmill by pivoting the operation bar, the engaging members are engaged with one of the recesses in different folded positions.

5 Claims, 8 Drawing Sheets

FOLDABLE MECHANISM FOR TREADMILLS

FIELD OF THE INVENTION

The present invention relates to a foldable mechanism for treadmills and the mechanism allows the support board and the frame to be folded to be slim and compact.

BACKGROUND OF THE INVENTION

A conventional treadmill generally includes an upright frame and a support board is connected to the upright frame, two rollers driven by a motor are connected to two ends of the support board and an endless belt is driven by the rollers. The upright frame and the support board are generally securely to each other so that the conventional treadmill occupies a large space.

A foldable mechanism was developed and allows the treadmill to be folded to reduce the space when not in use. A cylinder is used to lift one end of the support board which is then pivoted to be parallel to the upright frame. The support board is supported by the extended cylinder to prevent it from pivoting downward. Nevertheless, the button for operating the cylinder generally is located at outside of the treadmill and can be easily touched unintentionally. Once the button is touched, the heavy support board may hurt people.

The present invention intends to provide a foldable mechanism for treadmills wherein the upright frame can be folded toward the support board and the folded status is locked and secured.

SUMMARY OF THE INVENTION

The present invention relates to a treadmill which comprises a horizontal frame with an endless belt rotatably connected thereto and two foldable mechanisms are connected to the horizontal frames. Two upright frames are pivotably connected to the two foldable mechanisms. A handle and a control panel are connected between the two upright frames. The two foldable mechanisms include two respective foldable sets and an operation bar is connected between the two foldable sets.

Each foldable set has an operation member fixed to the upright frame corresponding thereto and the operation member has a groove defined in a side thereof. A periphery defining the groove includes multiple recesses. Two end plates each have a first end fixed to one of two ends of the operation bar and the other end of each end plate is pivotably connected to the foldable set corresponding thereto. An engaging member extends from the first end of each end plate and is movably inserted into the groove of the operation member. The engaging members are engaged with one of the recesses in different folded positions of the treadmill.

The primary object of the present invention is to provide a foldable mechanism for folding a treadmill, wherein the operation bar for activating the folding mechanism includes two engaging members which are movably inserted into two respective grooves of two operation members and are engaged with one of multiple recesses in different folded positions of the treadmill.

Another object of the present invention is to provide a foldable mechanism for folding a treadmill, wherein the operation bar is supported on the ground at an angle when the folded treadmill is in upright position.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
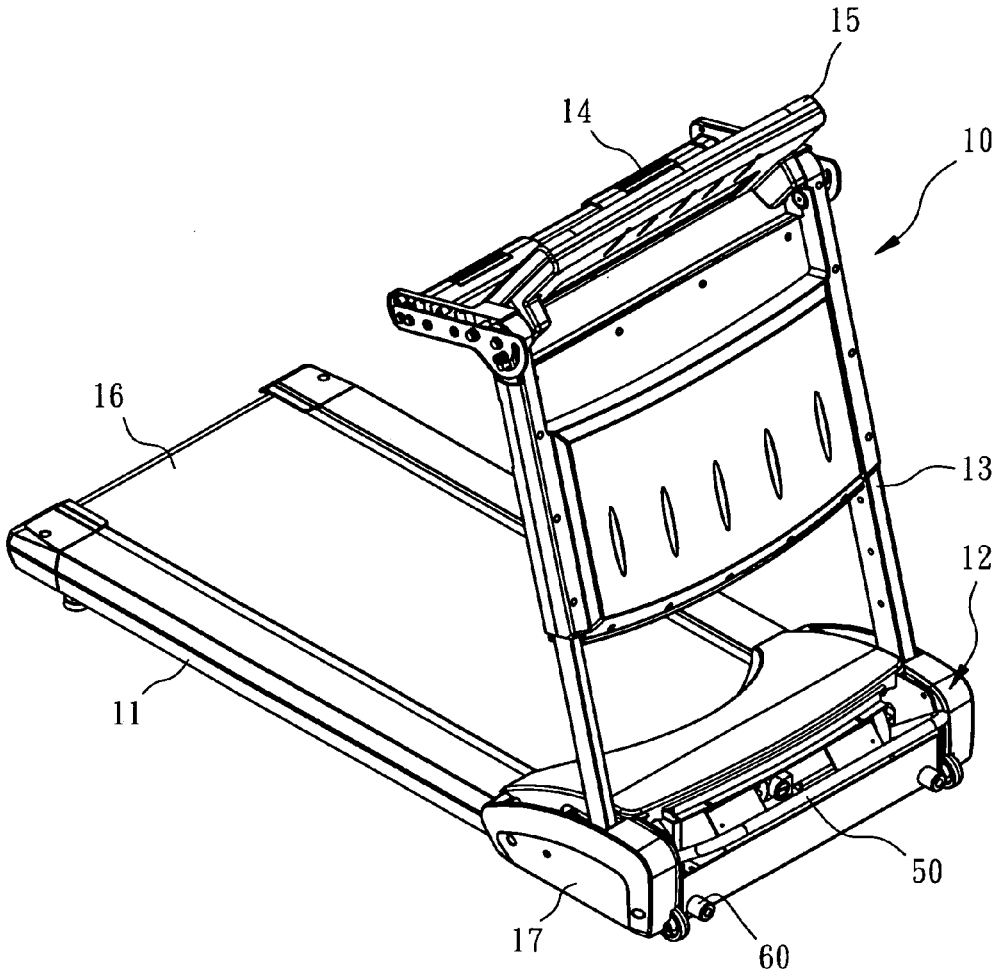
FIG. 1 is a perspective view to show the treadmill with the foldable mechanism of the present invention.
Figure 2:
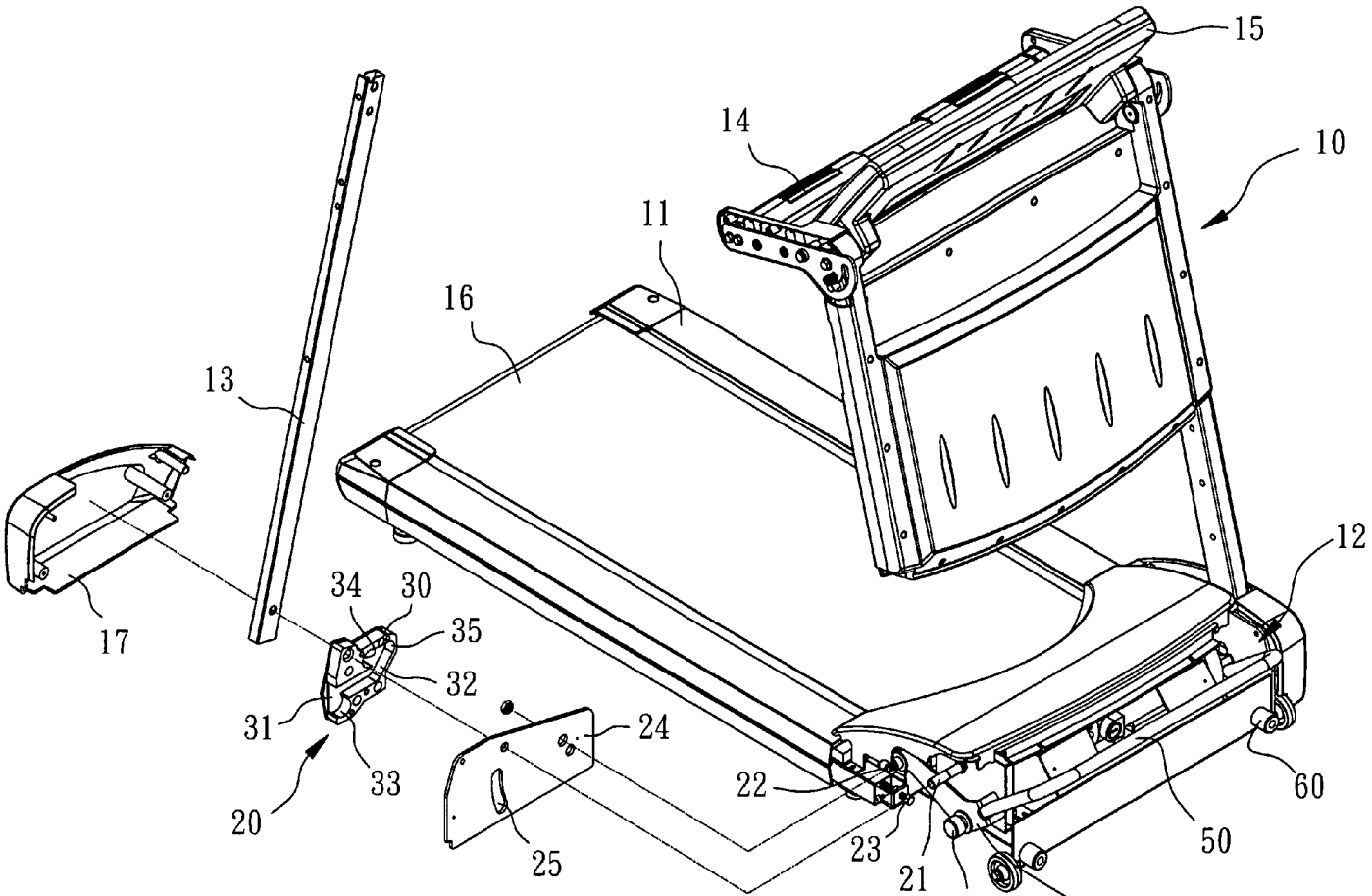
FIG. 2 is an exploded view to show the foldable mechanism of the present invention.
Figure 3:
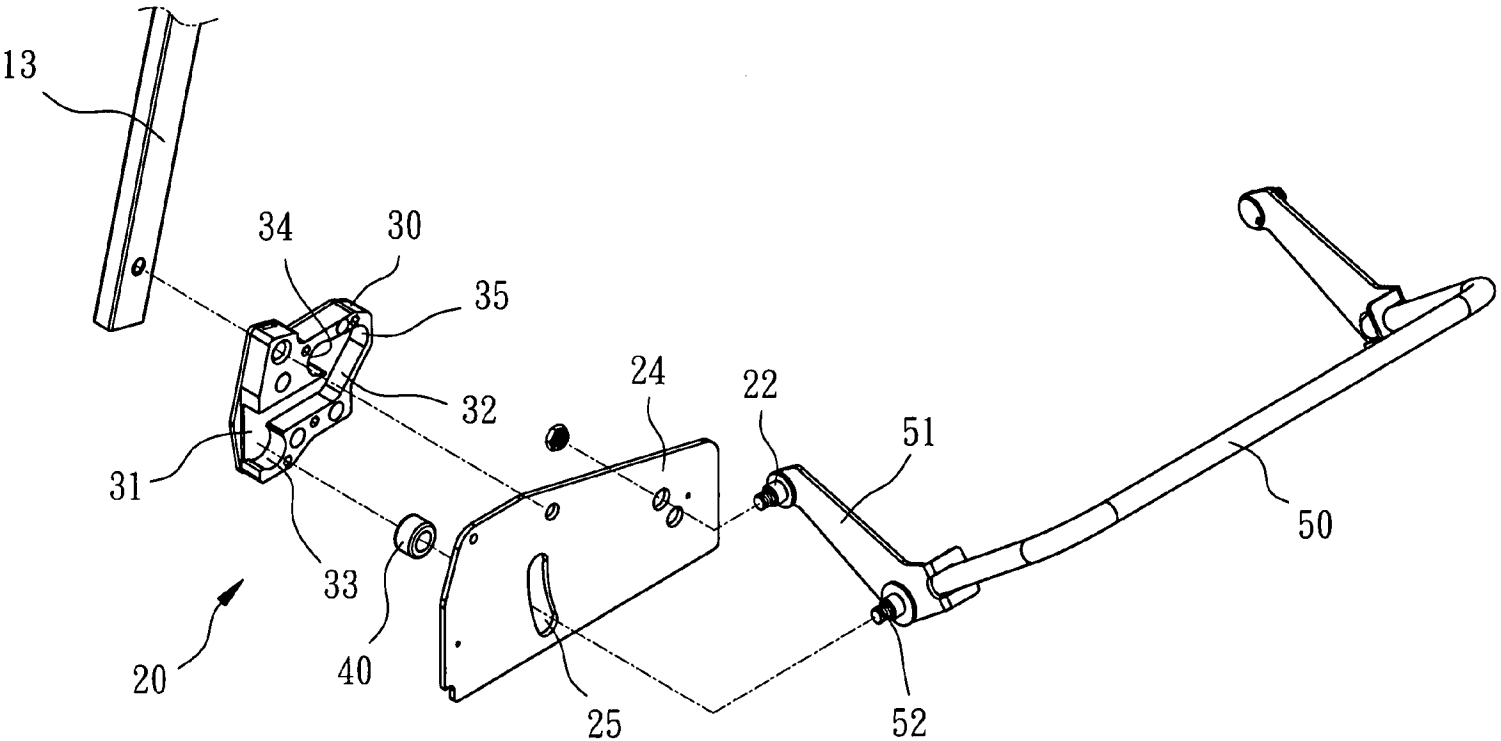
FIG. 3 is an exploded view to show the operation bar with the end plate, the side plate, the operation member and the upright frame of the present invention.

Referring to FIGS. 1 to 4, the treadmill 10 includes a horizontal frame 11 which includes two elongate frames and an endless belt 16 is rotatably connected between the two elongate frames. The endless belt 16 connected with two rollers (not shown) which are driven by a motor (not shown). Two foldable mechanisms 12 are connected to the two elongate frames of the horizontal frames 11. Two upright frames 13 are pivotably connected to the two foldable mechanisms 12 and can be pivoted toward the horizontal frame 11. A handle 14 and a control panel 15 are connected between the two upright frames 13.

The two foldable mechanisms 12 include two respective foldable sets 20 and an operation bar 50 is connected to the two foldable sets 20. Each foldable set 20 has an operation member 30 which is fixed to the upright frame 13 corresponding thereto. The operation member 30 has a groove 31 defined in a side thereof and a periphery 32 defining the groove 31 includes first, second and third recesses 33-35. The first and third recesses 33, 35 are located on two ends of the groove 31 and the second recess 34 is located beside the third recess 35.

Two end plates 51 each have a first end fixed to one of two ends of the operation bar 50 and the other end of each end plate 51 pivotably connected to the foldable set 20 corresponding thereto. A protrusion 52 extends from the first end of the end plate 51 and a connection rod 22 extends from the second end of the end plate 51. Two side plates 24 are connected to the two end plates 51 and each have a curved slot 25 defined therethrough. The connection rod 22 extends through the side plate 24 and is connected with a nut, and the protrusion 52 movably extends through the curved slot 25 and an engaging member 40 is mounted to the protrusion 52. The engaging member 40 is a bearing or a roller. The engaging member 40 is engaged with one of the recesses 33-35 of the operation member 30 corresponding thereto. Two covers 17 are mounted to the outside of the foldable sets 20 respectively and one end of each upright frame 13 extends through a notch in each of the covers 17 and is pivotably mounted to a positioning rod 21 on the treadmill 10.

Figure 4:
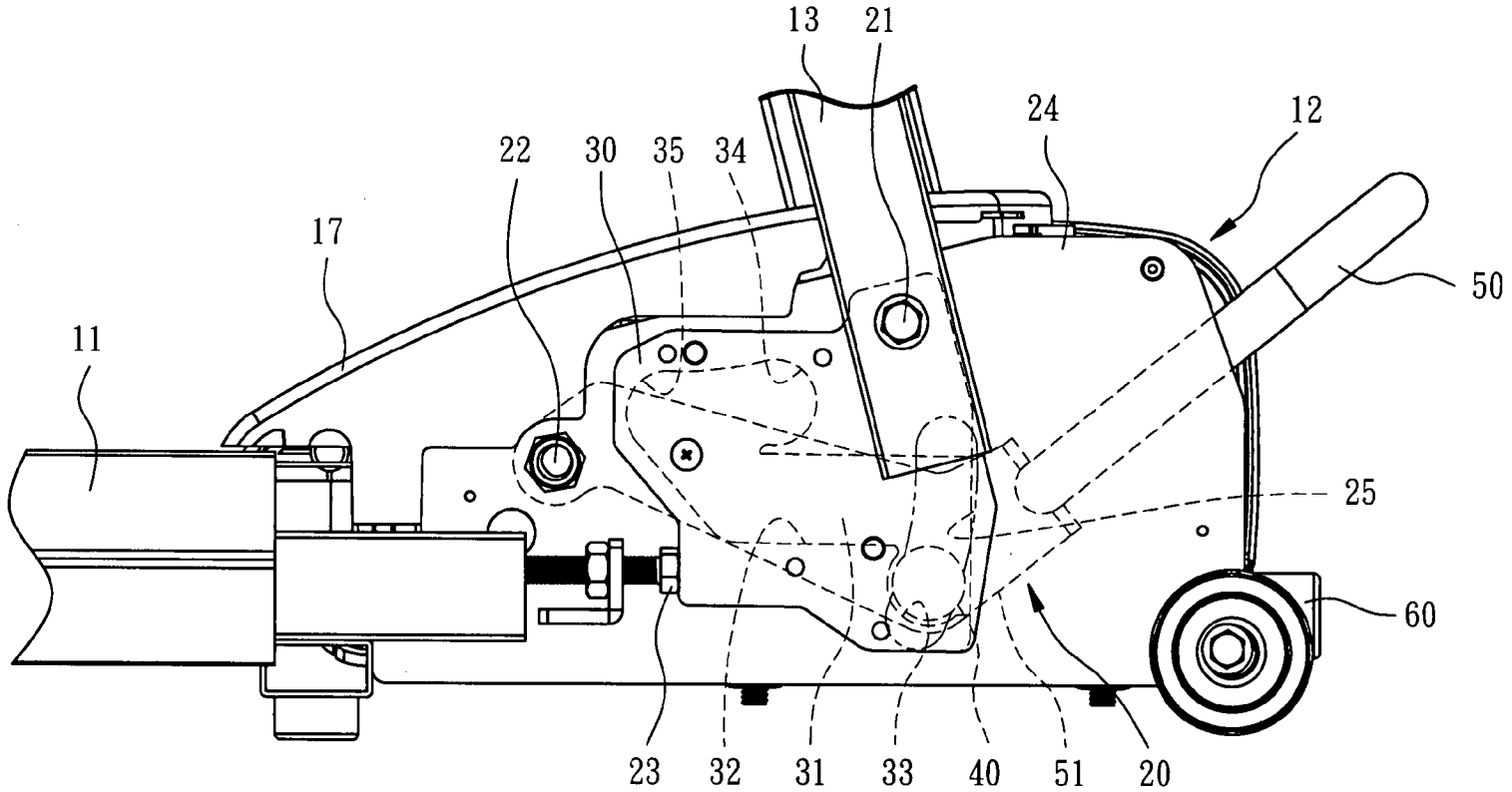
FIG. 4 shows that the engaging member is engaged with the first recess in the groove of the operation member when the treadmill is in use.

As shown in FIG. 4, when the treadmill 10 is in operation position, the engaging members 40 are engaged with the first recesses 33 of the two operation members 30. Two stop members 23 extend from two distal ends of the two elongate frames, the two operation members 30 each have a side being in contact with the stop member 23 when the two upright frames 13 are positioned at operation position. By this way, the operation members 30 are well positioned and the upright frames 13 are held at the inclined positions as shown.

Figure 5:
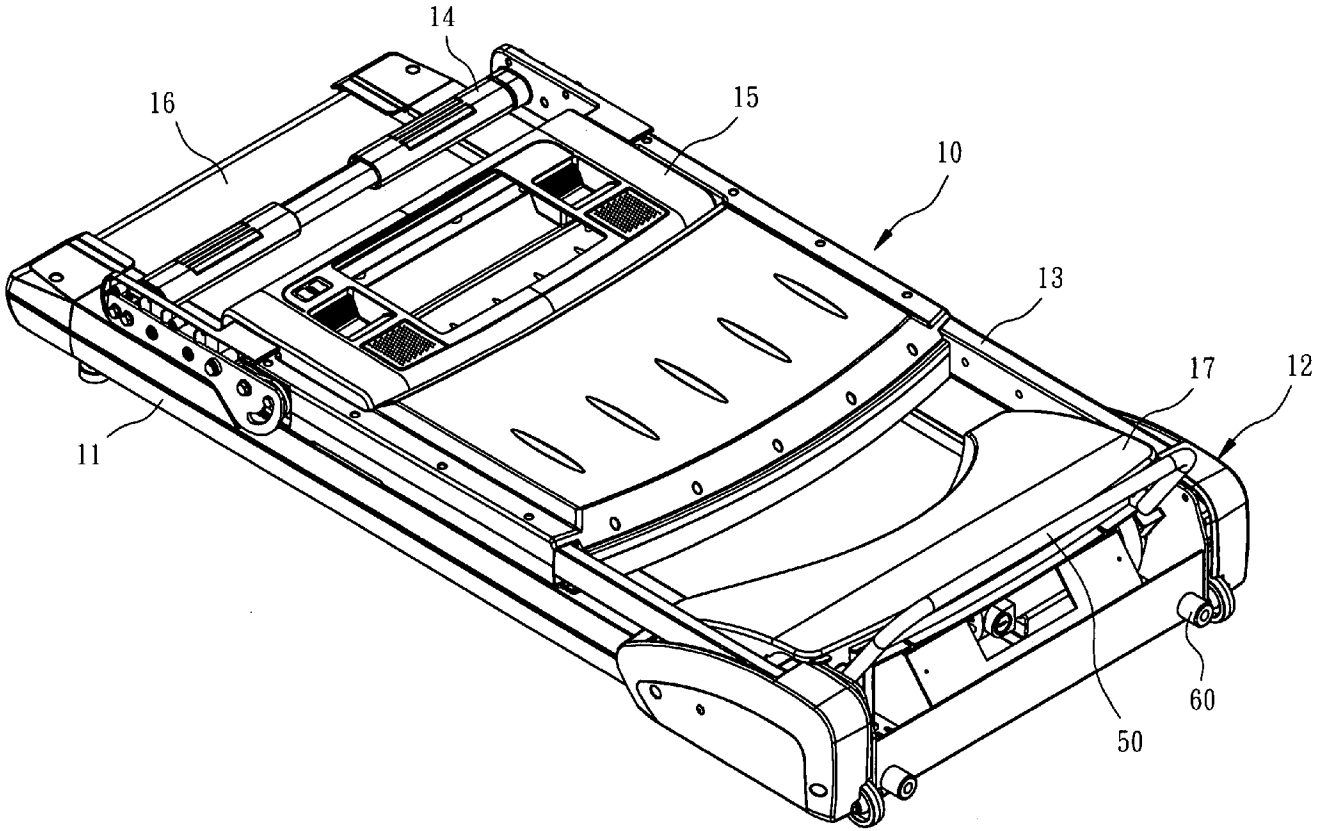
FIG. 5 is a perspective view to show that the upright frame is folded on the horizontal frame of the treadmill.
Figure 6:
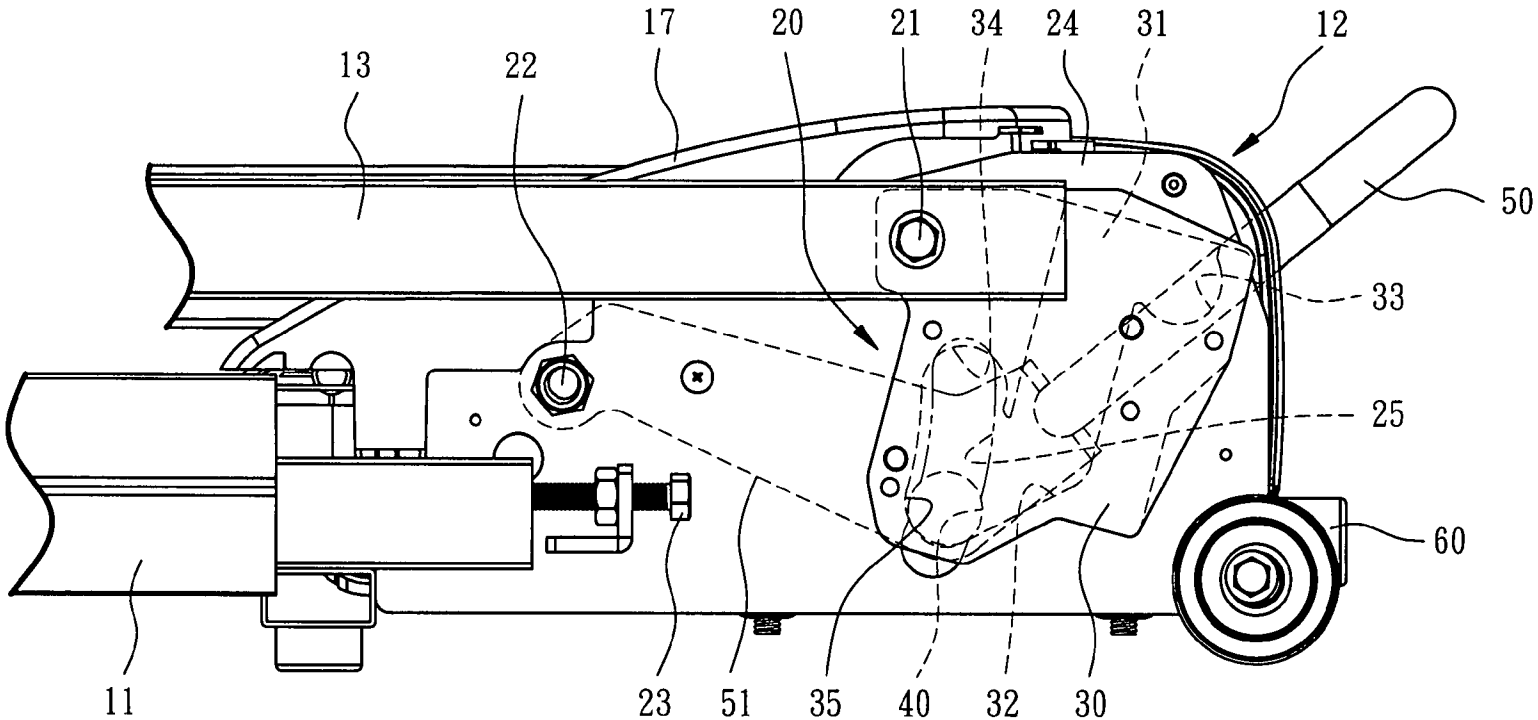
FIG. 6 shows that the engaging member is engaged with the third recess in the groove of the operation member when the treadmill is in the status in FIG. 5.

As shown in FIGS. 5 and 6, when folding the treadmill 10, the user pivots the operation bar 50, the end plates 51 are pivoted about the connection rods 22, the protrusions 52 move along the curved slots 25 and the operation members 30 are rotated until the engaging members 40 are engaged with the third recesses 35. The upright frames 13 are pivoted to rest on the horizontal frame 11. The travel of the engaging members 40 in the grooves 31 ensures that the upright frames 13 do not hit the horizontal frame 11.

Figure 7:
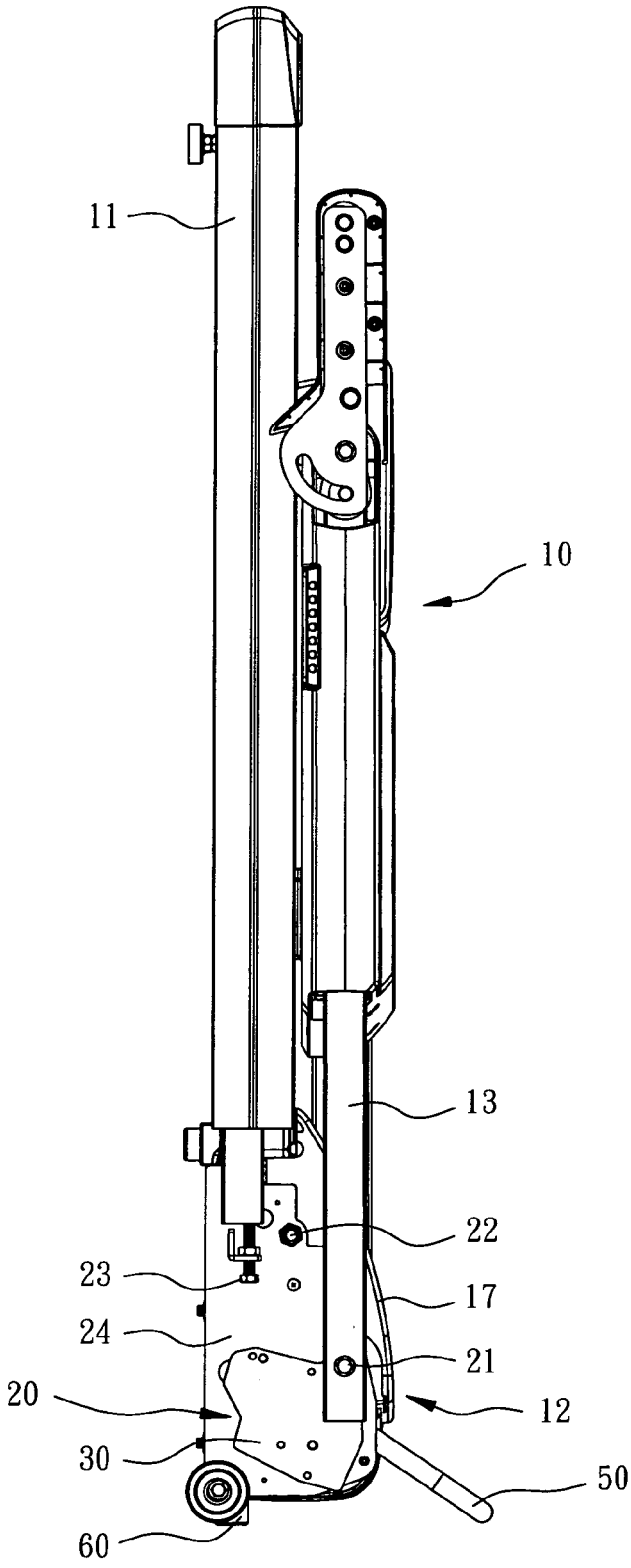
FIG. 7 shows that the treadmill is folded in upright position.
Figure 8:
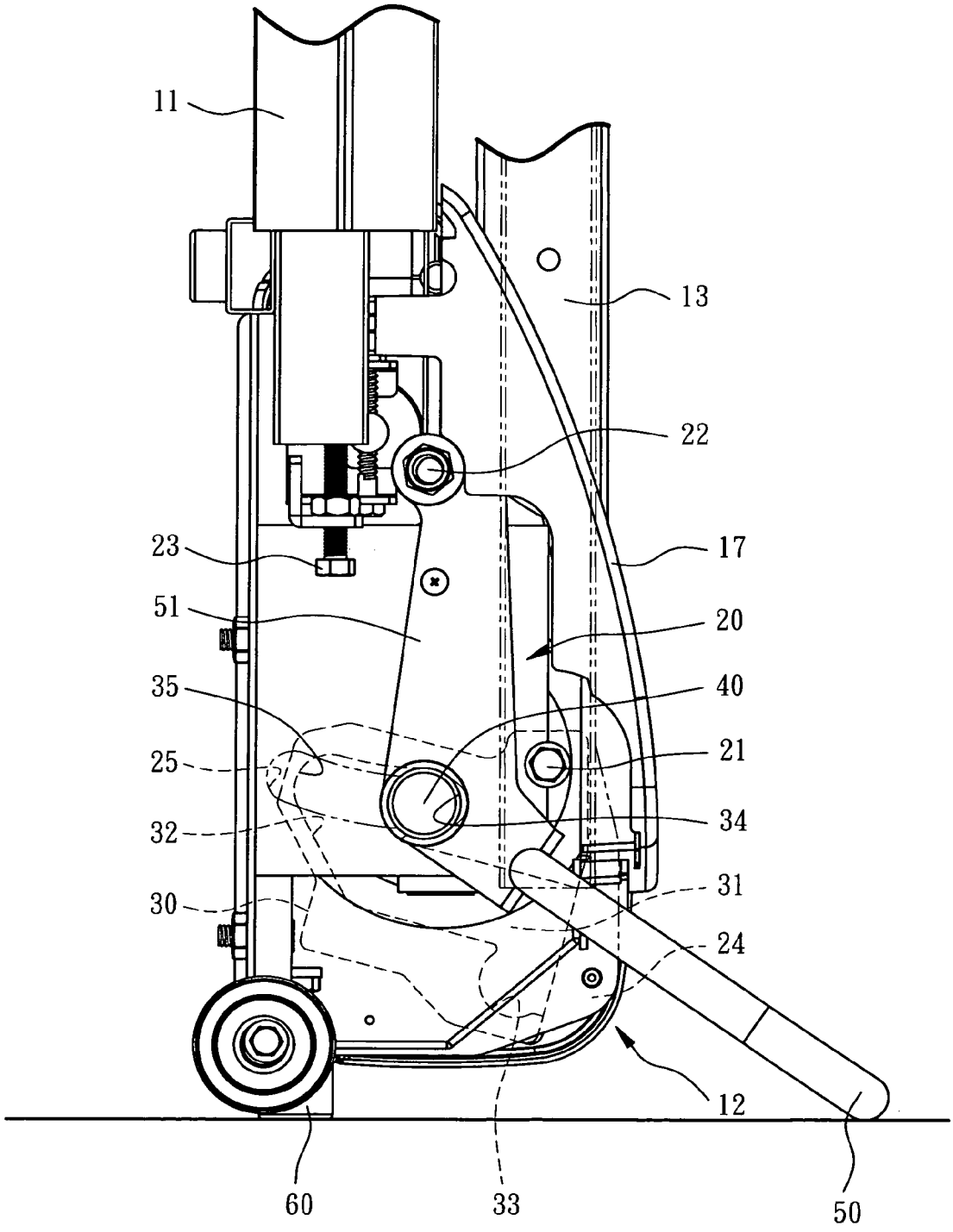
FIG. 8 shows that the engaging member is engaged with the second recess in the groove of the operation member when the treadmill is in the status in FIG. 7, the operation bar is supported on the ground.

As shown in FIGS. 7 and 8, the folded treadmill 10 may also be positioned upright. The operation bar 50 is supported on the ground at an angle when the folded treadmill is in upright position and two pads 60 extend from a board between the two foldable sets 20 and are in contact with the ground when the operation bar 50 is supported on the ground. The two pads 60 and the operation bar 50 form a plane within which the center of weight of the treadmill is located so that the upright treadmill 10 is in a stable status. When the treadmill 10 is arranged to the upright position and the operation bar 50 is in contact with the ground and pivoted to support the weight of the treadmill 10, the engaging members 40 are moved from the third recesses 35 to the second recesses 34. This ensures that the operation members 30 are not rotated even if the treadmill 10 is up-side-down.

While we have shown and described the embodiment in accordance with the present invention, it should be clear to those skilled in the art that further embodiments may be made without departing from the scope of the present invention.

What is claimed is:

1. A treadmill comprising:

a horizontal frame having an endless belt rotatably connected thereto and two foldable mechanisms connected to respective sides of the horizontal frame, two upright frames pivotably connected to the two foldable mechanisms, a handle and a control panel connected between the two upright frames;

the two foldable mechanisms including two respective foldable sets and an operation bar connected to the two foldable sets, each foldable set having an operation member which is fixed to the upright frame corresponding thereto, the operation member having a groove defined in a side thereof and a periphery defining the groove including multiple recesses, and two end plates each having a first end fixed to one of two ends of the operation bar and a second end of each end plate pivotably connected to the foldable set corresponding thereto, a connection rod extending from the second end of each end plate and fixed to one of two side plates which are fixed to the treadmill, each side plate having a curved slot, an engaging member extending from the first end of each end plate and movably inserted into the groove of the operation member, the engaging member extending through the curved slot of each side plate and engaged with one of the recesses.

2. The treadmill as claimed in claim 1, wherein each engaging member is a bearing.

3. The treadmill as claimed in claim 1, wherein the horizontal frame includes two elongate frames and two stop members extend from two distal ends of the two elongate frames, the two operation members each have a side being in contact with the stop member when the two upright frames are positioned at operation position.

4. The treadmill as claimed in claim 1, wherein the operation bar is supported on the ground at an angle when the folded treadmill is in upright position.

5. The treadmill as claimed in claim 4, wherein two pads extend from a board between the two foldable sets and are in contact with the ground when the operation bar is supported on the ground.

* * * * *